US008440895B2

(12) United States Patent
Nakata et al.

(10) Patent No.: US 8,440,895 B2
(45) Date of Patent: May 14, 2013

(54) PEDAL FOR DRUM

(75) Inventors: Eizo Nakata, Osaka (JP); Manabu Morioka, Osaka (JP); Takashi Wariishi, Osaka (JP); Shunsaku Tsuji, Osaka (JP)

(73) Assignee: Sakae Rhythm Musical Instrument Ltd., Osaka-Shi (JP)

( * ) Notice: Subject to any disclaimer, the term of this patent is extended or adjusted under 35 U.S.C. 154(b) by 151 days.

(21) Appl. No.: 12/836,790

(22) Filed: Jul. 15, 2010

(65) Prior Publication Data

US 2011/0030532 A1 Feb. 10, 2011

(30) Foreign Application Priority Data

Jul. 15, 2009 (JP) ..... 2009-167298

(51) Int. Cl.
*G10D 13/02* (2006.01)

(52) U.S. Cl.
USPC ..... 84/422.1

(58) Field of Classification Search ..... 84/422.1, 84/422.2, 422.3, 421
See application file for complete search history.

(56) References Cited

U.S. PATENT DOCUMENTS 5,936,177 A * 8/1999 Shigenaga ..... 84/422.1

FOREIGN PATENT DOCUMENTS

| | | |
|---|---|---|
| JP | 08-044346 | 2/1996 |
| JP | 08-248949 | 9/1996 |
| JP | 10-039860 | 2/1998 |

* cited by examiner

*Primary Examiner* — Kimberly Lockett
(74) *Attorney, Agent, or Firm* — Kratz, Quintos & Hanson, LLP

(57) ABSTRACT

To provide a drum pedal with a suppressed deflection and no fluctuation in beat timing or beat force of a beater, which allows the player to perform with a desired well-modulated tone, and to obtain the direct feeling, which is a sense of the depressing force being directly transferred to the beater attained by the good operability and the maintained stable attitude of the entire pedal, without inviting an increase in weight or material cost.

A drum pedal includes at least: a pedal frame 2 having a base portion 20, a right and left pair of strut portions 21 and a heel portion 22; a rotation shaft 3 to which a beater 5 that beats a drumhead is mounted, and that is horizontally pivotally supported between respective top end portions 21*a* of the strut portions 21; and a foot board 4 that has its base end side rotatably supported by the heel portion 22, and that rotates the rotation shaft 3 through a coupling member 40 extending from its tip end side in accordance with the depressing operation of the player.

19 Claims, 14 Drawing Sheets

(a)

(b)

PEDAL FOR DRUM

TECHNICAL FIELD

The present invention relates to a drum pedal for beating the drumhead of a bass drum.

BACKGROUND ART

What have conventionally been provided as drum pedals of this kind are the ones each structured with: a base plate that is to be placed on the floor and that has rigidity, being made of steel or the like; a metal strut frame that is mounted toward the front side in the base plate, being made of aluminum by die casting technique; a heel portion that is mounted to the rear end portion of the base plate, being made of aluminum by die casting technique; a rotation shaft arranged horizontally to the top end portion of the strut frame; and a beater mounted to the rotation shaft; a wheel member that similarly rotate integrally with the rotation shaft; and a foot board that has its base end portion upwardly and downwardly rotatably supported by the heel portion, and that has its tip end portion coupled to one end of a chain wrapped around the outer circumference of the wheel member (for example, see Patent Documents 1 to 3).

With such a conventional drum pedal, the strut frame for supporting the rotation shaft having the beater is fixed by being screwed to the top face of the base plate. This strut frame is structured as a massive frame standing substantially vertically, because it is repeatedly acted upon, frontward and rearward, the depressing force exerted from the foot board via the rotation shaft through the chain, and the reaction force from the drumhead in response to the action of the beater. However, the force applied to the strut frame is transferred to the base plate, specifically, the force acts repeatedly in the direction leaning frontward and rearward from the strut frame. Such a force is concentrated at the base plate, causing a great deflection, whereby the strut frame also greatly swings frontward and rearward. Such swing of the strut frame invites fluctuation of the timing of the beater beating the drumhead and the beat force. This poses a problem that the player cannot perform with an exactly desired well-modulated tone. Also, the deflection of the base plate causes the entire pedal to jounce and lose its stability. Thus, the depressing force cannot be transferred to the beater directly as it is, and the direct feeling vanishes. This may break concentration of the player.

In order to suppress such problems, what has conventionally been devised is to form the base plate to have a great thickness, to provide stiffening ribs to reinforce the base plate itself, or to arrange the strut frame on somewhat rear side relative to the base plate front end portion, thereby shortening the remainder portion of the base plate extending rearward relative to the strut frame root portion, such that the deflection can be as minimized as possible. However, the reinforcement of the base plate itself invites an increase in its weight, which in turn makes it troublesome to be carried, and increases the material cost. Further, if the strut frame is provided to stand up at the position excessively rearward, then the strut frame hits the player's foot, posing another problem of poor operability. Therefore, such conventional measures have limitations.

Citation List

Patent Literature

Patent Document 1 JP-A No. 8-248949
Patent Document 2 JP-A No. 8-44346
Patent Document 3 JP-A No. 10-39860

SUMMARY OF INVENTION

Technical Problem

Accordingly, taking into consideration of the situation described in the foregoing, the present invention has been made to solve the problems by providing a drum pedal with a suppressed deflection and no fluctuation in beat timing or beat force of a beater, which allows the player to perform with a desired well-modulated tone, and to obtain the direct feeling, which is a sense of the depressing force being directly transferred to the beater attained by the good operability and the maintained stable attitude of the entire pedal, without inviting an increase in weight or material cost.

Solution to Problem

In order to solve the problems described above, the present invention provides a drum pedal, including: a pedal frame that has a frontward to rearward elongated base portion to be placed on a floor, a right and left pair of strut portions extending upward from a front end portion of the base portion, and a heel portion arranged at a rear end portion of the base portion; a rotation shaft that has a beater for beating a drumhead mounted, and that is horizontally pivotally supported by top end portions of the strut portions; and a foot board that has its base end side rotatably supported by the heel portion, and that rotates the rotation shaft through a coupling member extending from its tip end side in accordance with a depressing operation of a player, wherein the base portion and the strut portions structuring the pedal frame are integrally formed with a metal material by casting.

Here, it is preferable to structure such that the strut portions extend from right and left edge portions of the front end portion of the base portion, the strut portions being structured such that each of front end faces of root portions of the strut portions is substantially continuously flush with a front end face of the base portion.

Further, it is preferable to structure such that the strut portions are tilted so as to be positioned further rearward as the strut portions are increased in height, and to be wider in frontward to rearward width as the strut portions are decreased in height, whereby each of rear end faces of the root portions of the strut portions is continuous to a top face of the base portion, drawing a gentle curve in a substantial C-shape as seen sideways.

Still further, it is preferable that the heel portion is also integrally formed when the casting with the metal material is carried out, and a metal sleeve element for accommodating a bearing member is separately attached to a support portion that supports the base end side of the foot board formed at the heel portion. In this case, it is preferable that the attachment of the sleeve element is carried out by previously inserting the sleeve element into a cast mold when the casting with the metal material is carried out, to achieve an integrated formation.

Still further, it is preferable that clamp means for clamping a hoop of a bass drum is provided at the front end portion of the base portion of the pedal frame, and the clamp means is positioned at a position interchangeable between right and left sides.

The present invention also provides a double type drum pedal, including: first and second beaters; first and second rotation shafts that have the respective beaters fixed thereto; first and second foot boards that allow the rotation respective shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, the base portion and the strut portions being integrally formed with a metal material by casting, one end of the first rotation shaft is pivotally supported by one of the pair of strut portions of the first pedal frame, a bearing portion is provided at an end portion of the second rotation shaft pivotally supported by other one of the pair of strut portions, the end portion projecting toward the first rotation shaft, and other end of the first rotation shaft is pivotally supported by the bearing portion.

The present invention also provides a double type drum pedal, including first and second beaters; first and second rotation shafts that have the respective beaters fixed thereto; first and second foot boards that allow the respective rotation shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, the base portion and the strut portions being integrally formed with a metal material by casting, one end of the first rotation shaft is pivotally supported by one of the pair of strut portions of the first pedal frame, a bearing portion is provided at an end portion of the second rotation shaft pivotally supported by other one of the pair of strut portions, the bearing portion being rotatably supported by a bearing member in one of a state where the bearing portion is inserted into inside the other one of the pair of strut portions in its entirety and a state where a partial base end side portion of the bearing portion is inserted into inside the other one of the pair of strut portions, and other end of the first rotation shaft is pivotally supported by the bearing portion as being inserted into the bearing portion to reach a position inside the one of the pair of strut portions.

The present invention also provides a double type drum pedal, including: first and second beaters; first and second rotation shafts that have the respective beaters fixed thereto; first and second foot boards that allow the respective rotation shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, one end of the first rotation shaft is pivotally supported by one of the pair of strut portions of the first pedal frame, a bearing portion is provided at an end portion of the second rotation shaft pivotally supported by other one of the pair of strut portions, the bearing portion being rotatably supported by a bearing member in one of a state where the bearing portion is inserted into inside the other one of the pair of strut portions in its entirety and a state where a partial base end side portion of the bearing portion is inserted into inside the other one of the pair of strut portions, and other end of the first rotation shaft is pivotally supported by the bearing portion as being inserted into the bearing portion to reach a position inside the one of the pair of strut portions.

Advantageous Effects of Invention

In the drum pedal according to the present invention structured as described in the foregoing, because the base portion and the strut portions structuring a pedal frame are integrally formed with a metal material by casting, leakage of a sound from any assembled portion can be eliminated, and the depressing force and the reaction force from the drumhead can be received evenly by the strut portion and the base portion as a whole, whereby a structure free of a deflection due to local force concentration can be obtained. Accordingly, no fluctuation in beat timing or beat force of the beater occurs, allowing the player to perform with a desired well-modulated tone. Further, because the entire pedal maintains its stable attitude, the player can obtain the direct feeling, which is a sense of the depressing force being directly transferred to the beater. Still further, the present invention eliminates the necessity to reinforce the portion where the force is concentrated, which would otherwise be required in the conventional ones. Thus, the present invention contributes toward not only a reduction in the material cost, but also a reduction in the total weight of the pedal, making it convenient to be carried.

Further, it is structured such that the strut portions extend from right and left edge portions of the front end portion of the base portion, the strut portions being structured such that each of front end faces of root portions of the strut portions is substantially continuously flush with a front end face of the base portion. Therefore, even when the player's foot put on the foot board is displaced sideways during performance, it will not hit the strut portions. Thus, the stable attitude of the pedal can be maintained and its operability can be improved.

Still further, it is structured such that the strut portions are tilted so as to be positioned further rearward as the strut portions are increased in height toward, and to be wider in frontward to rearward width as the strut portions are decreased in height, whereby the rear end faces of the root portions of the strut portions are continuous to a top face of the base portion, each drawing a gentle curve in a substantial C-shape as seen sideways. This makes it possible to maintain an appropriate distance while avoiding excessive approach of the rotation shaft to the drumhead. Further, the root portion can maintain enough support strength. Still further, the strut portions as a whole form a curved shape along an arc-shaped track of the rotating tip of the foot board. Thus, the tip end side of the foot board swings as being hidden between the strut portions during performance of the player, thereby achieving an excellent shape in terms of appearance also.

Still further, the heel portion is also integrally formed when the casting with the metal material is carried out, and a metal sleeve element for accommodating a bearing member is separately attached to a support portion that supports the base end side of the foot board formed at the heel portion. Therefore, the bearing member can be attached with great accuracy. In particular, because the attachment of the sleeve element is carried out by previously inserting the sleeve element into a cast mold when the casting is carried out with the metal material, an improvement in the manufacturing efficiency can be achieved.

Still further, because clamp means for clamping a hoop of a bass drum is provided at the front end portion of the base portion of the pedal frame, and the clamp means is positioned at a position interchangeable between right and left sides, an identical pedal frame can be used for both the single type and the twin type.

The present invention also provides a double type drum pedal, including: first and second beaters; first and second rotation shafts that have the respective beaters fixed thereto; first and second foot boards that allow the respective rotation shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, the base portion and the strut portions being integrally formed with a metal material by casting, one end of the first rotation shaft is pivotally supported by one of the pair of strut portions of the first pedal frame, a bearing portion is provided at an end portion of the second rotation shaft pivotally supported by other one of the pair of strut portions, the end portion projecting toward the first rotation shaft, and other end of the first rotation shaft is pivotally supported by the bearing portion. The double type drum pedal having such a structure achieves the effect similarly to that achieved by the above-described drum pedal, namely, a suppressed deflection, the capability of allowing the player to perform with a desired well-modulated tone and to obtain the direct feeling, without incurring an increase in weight or material cost. In addition thereto, the double type drum pedal of the present invention eliminates the necessity of an auxiliary strut portion which would otherwise be required in the conventional ones, and makes it possible to manufacture using a common frame for both the single type and the twin type, thereby realizing a reduction in costs.

Further, it is structured such that one end of the first rotation shaft is pivotally supported by one of the pair of strut portions of the first pedal frame, a bearing portion is provided at an end portion of the second rotation shaft pivotally supported by other one of the pair of strut portions, the bearing portion being rotatably supported by a bearing member in one of a state where the bearing portion is inserted into inside the other one of the pair of strut portions in its entirety and a state where a partial base end side portion of the bearing portion is inserted into inside the other one of the pair of strut portions, and other end of the first rotation shaft is pivotally supported by the bearing portion as being inserted into the bearing portion to reach a position inside the one of the pair of strut portions. Therefore, because the bearing portion itself bearing the load of the first rotation shaft is supported by the strut portion, the second rotation shaft will not suffer from the moment force. Accordingly, any deviation of the rotation of the second rotation shaft that hinders the operation will not occur. Hence, the second rotation shaft can smoothly actuate the beater without any effect from the operation of the first rotation shaft, and the beater can also smoothly actuate.

DESCRIPTION OF EMBODIMENTS

Next, embodiments of the present invention will be described in detail with reference to the drawings.

Figure 1:
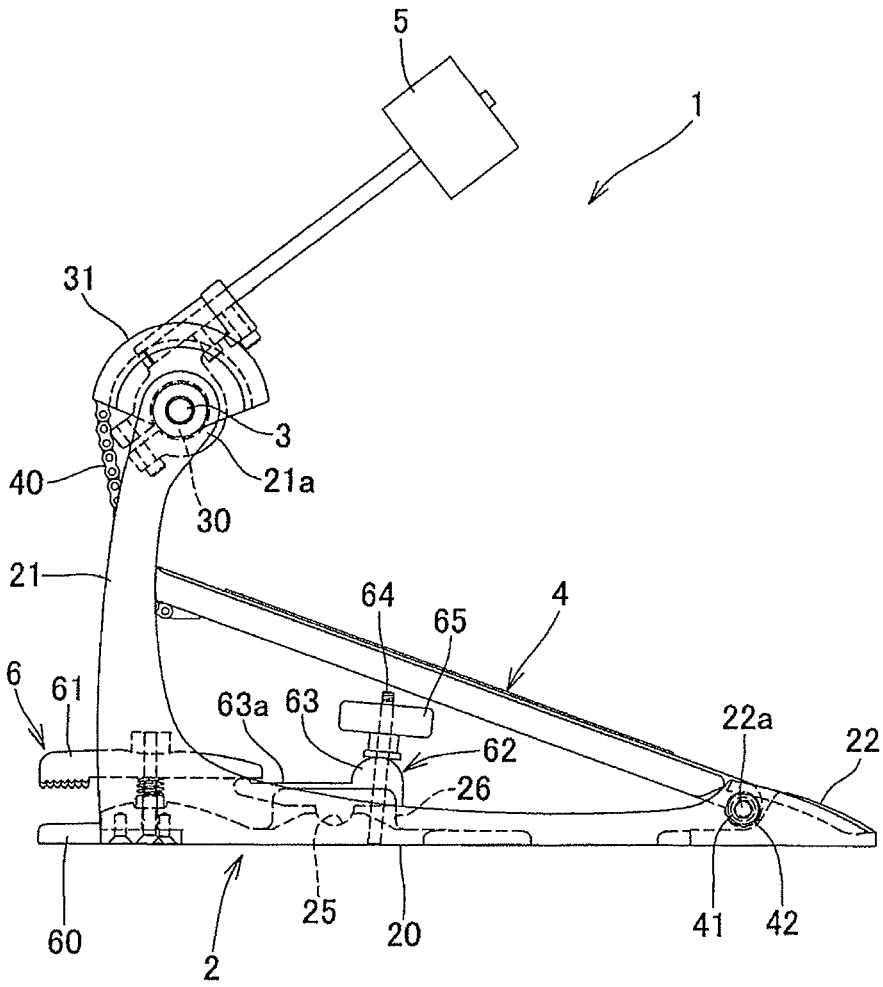
FIG. 1 is a side view showing a drum pedal according to a first embodiment of the present invention.

FIG. 1 is a side view showing the overall structure of a drum pedal according to the present invention. FIGS. 1 to 7 show a single type pedal according to a first embodiment, and FIGS. 11 to 14 show a twin type pedal according to a second embodiment. In the drawings, the reference character 1 denotes a drum pedal, 2 denotes a pedal frame, 3 denotes a rotation shaft, 4 denotes a foot board, and 5 denotes a beater.

Figure 2:
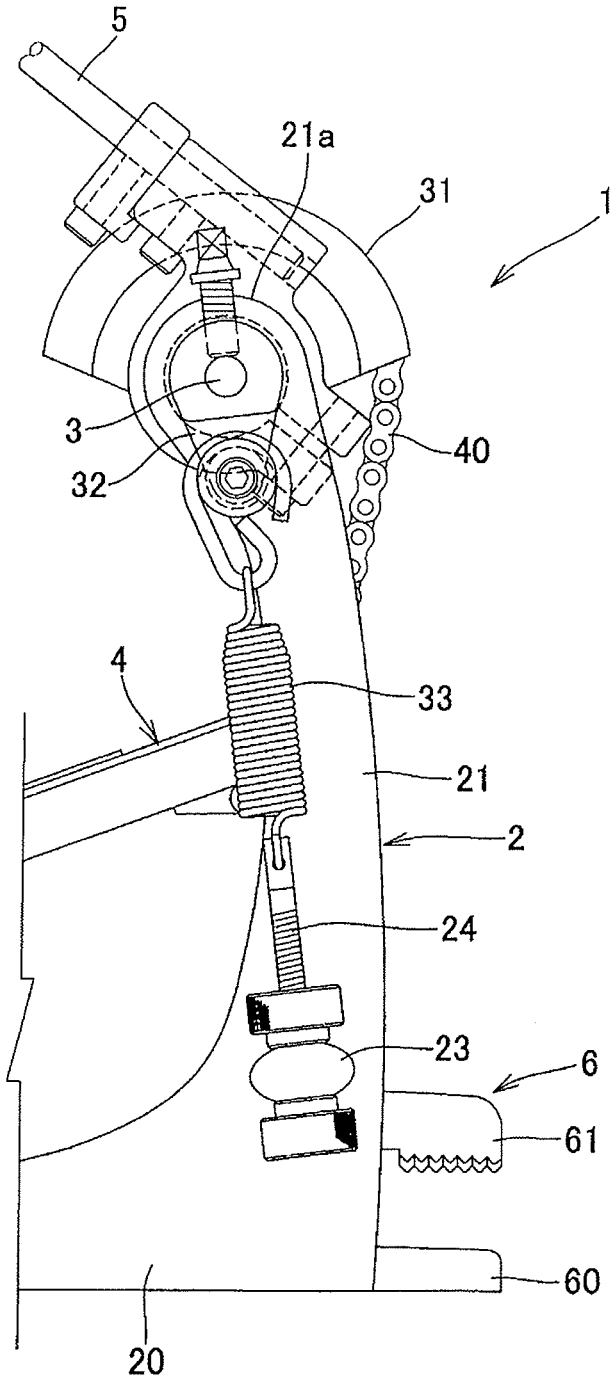
FIG. 2 is a side view showing a substantial part of the drum pedal according to the first embodiment of the present invention.
Figure 3:
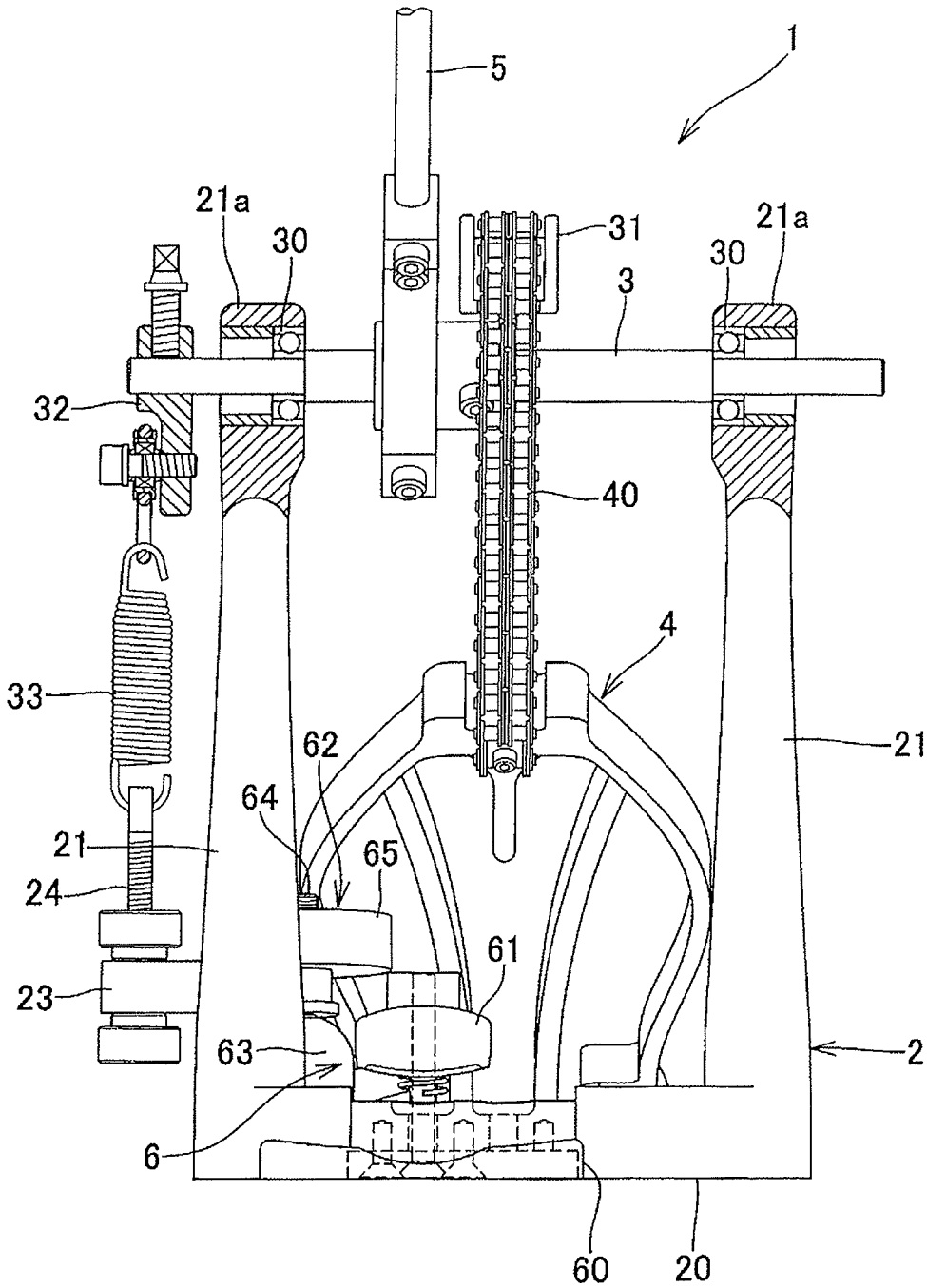
FIG. 3 is an elevation view showing the drum pedal according to the first embodiment of the present invention as seen from the front side.

As shown in FIGS. 1 to 3, a drum pedal 1 of the present invention includes at least: a pedal frame 2 that has a frontward to rearward elongated base portion 20 to be placed on the floor, a right and left pair of strut portions 21 extending upward from the front end portion of the base portion 20, and a heel portion 22 provided at the rear end portion of the base portion 20; a rotation shaft 3 that has a beater 5 for beating a drumhead mounted, and that is horizontally pivotally supported by top end portions 21*a* of the strut portions 21; and a foot board 4 that has its base end side rotatably supported by the heel portion 22, and that rotates the rotation shaft 3 through a coupling member 40 extending from its tip end side in accordance with the depressing operation of the player. The drum pedal 1 is characterized in that the base portion 20 and the right and left pair of strut portions 21 structuring the pedal frame 2 are integrally formed with a metal material by casting. The casting may be mold casting, sand casting and the like, or it may be die casting. In the present embodiment, the integrally formed pedal frame 2 is the one that has an excellent strength obtained by mold casting using an aluminum alloy material. It is to be noted that the metal material itself is not limited to the aluminum alloy, and a variety of materials can be used.

The base portion 20 structuring the pedal frame 2 is greater than the foot board 4 in front to rear dimension and width dimension. The base portion 20 has a support structure in which the front end side thereof is fixed to a hoop of a bass drum by clamp means 6, which will be described later, and on the rear end side thereof, a base end portion of the foot board 4 is rotatably supported. In the present invention, the elongated base portion 20 reaching the heel portion is integrally formed with the strut portions 21, so as to receive the reaction force of the beater by the entire frame made up of the base portion 20 and the strut portion 21. Therefore, the complicated and thick steel made structure as employed in the conventional base plate for preventing a deflection can be dispensed with. Thus, the structure having a reduced weight as a whole is obtained.

The strut portions 21 extend from the right and left edge portions of the front end portion of the base portion 20, and are structured such that the front end faces of the root portions of the strut portions 21 are substantially continuously flush with the front end face of the base portion 20. Thus, the pedal frame 2 is structured to be substantially in an L-shape as seen sideways. In such a manner, by arranging the strut portions 21 at the front end portion of the base portion 20, even when the player's foot put on the foot board 4 is displaced sideways during performance, it will not hit the strut portions 21. Thus, the stable attitude of the pedal can be maintained and its operability can be improved. In the conventional structure in which the strut frame is mounted to the base plate, when a structure in which the strut frame is arranged to stand up at the front end of the plate is employed, the length of the base plate at the portion extending rearward from the strut root portion is increased, and so is the deflection accordingly. In contrast thereto, in the present invention, because the base portion 20 reaching the heel portion 22 is integrally formed with the strut portions 21 with a metal material by casting, the long length does not result in a deflection, and such a mode is realized.

Further, the strut portions 21 are each tilted so as to be positioned further rearward as they are increased in height toward the top end sides where the rotation shaft 3 is present, and to be wider in frontward to rearward width as they are decreased in height, whereby the rear end faces of the root portions of the strut portions 21 are continuous to the top face of the base portion 20, each drawing a gentle curve in a substantial C-shape as seen sideways. Though the present embodiment is merely an example, and the present invention is not necessarily limited to such a shape, such a rearward tilt makes it possible to maintain an appropriate distance while avoiding excessive approach of the rotation shaft 3 to the drumhead. Further, the root portion being continuous to the base portion 20 as described above can maintain enough support strength. Still further, the strut portions 21 as a whole form a curved shape along an arc-shaped track of the rotating tip of the foot board 4. Thus, the tip end side of the foot board 4 swings as being always hidden between the strut portions 21 during performance of the player, thereby achieving an excellent shape in terms of appearance also.

Figure 4:
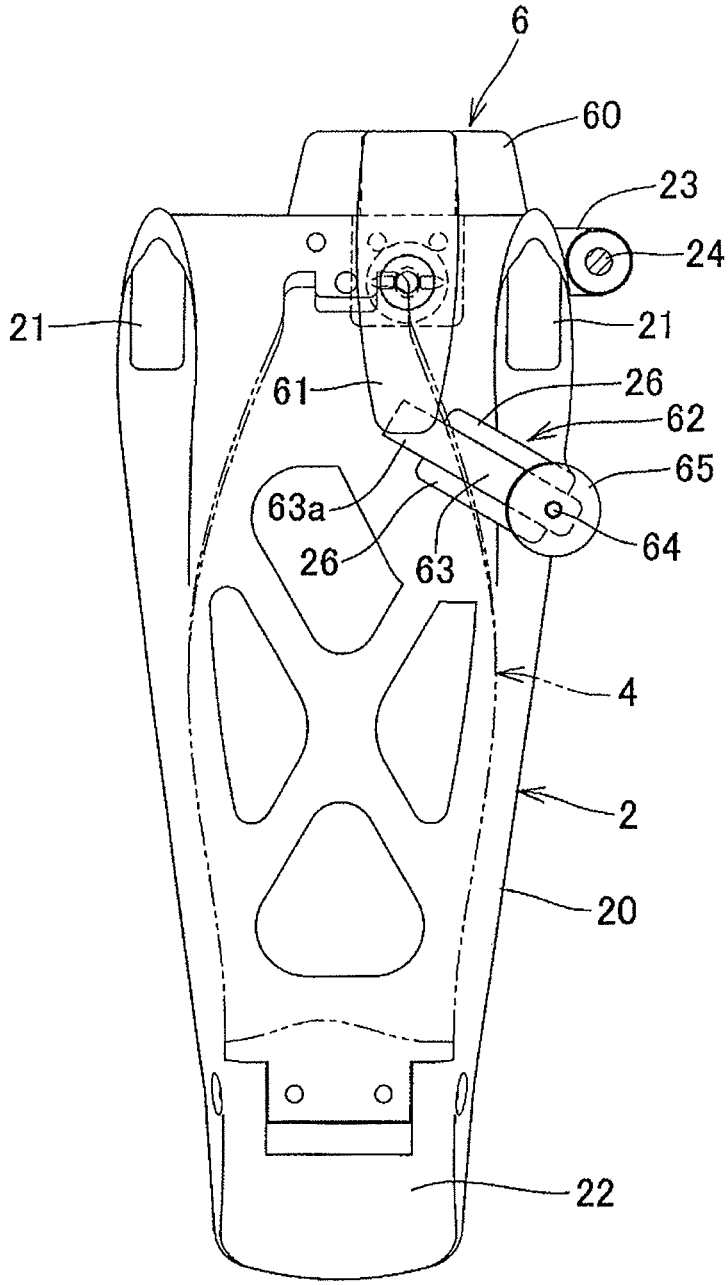
FIG. 4 is a partially omitted explanatory view showing the drum pedal according to the first embodiment of the present invention as seen from above.
Figure 5:
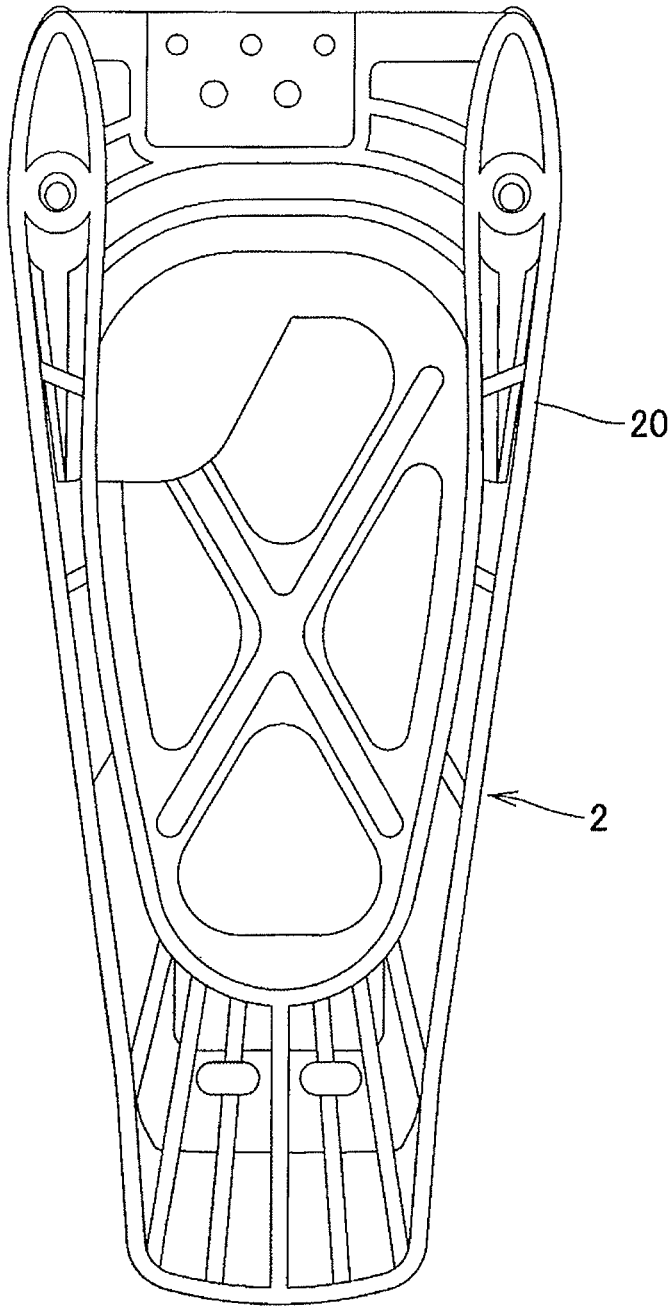
FIG. 5 is an explanatory view showing a pedal frame as seen from the bottom face.
Figure 6:
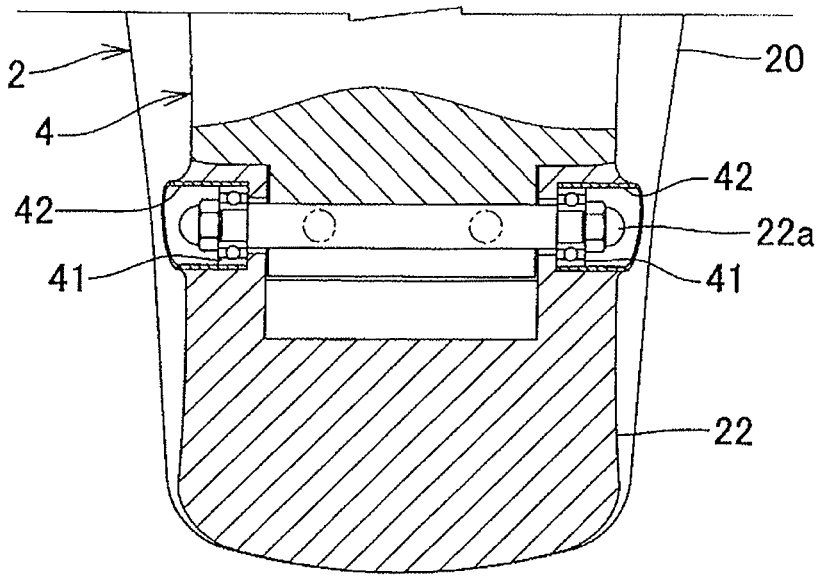
FIG. 6 is an explanatory cross-sectional view showing a substantial part of a heel portion.

As also shown in FIGS. 4 and 6, on the rear end side of the base portion 20, the heel portion 22 on which the heel of the player's hoot is put is formed. In the present embodiment, the heel portion 22 is also integrally formed with the rear end portion of the base portion 20 when the aforementioned casting is carried out, whereby a structure fewer in the number of components and lighter in weight is achieved. Being different from the conventional ones, the present structure cannot be obtained unless the base portion 20 and the strut portion 21 are integrally formed with the same metal material by casting, which cannot be realized by conventional ones having a steel base plate. The heel portion 22 is provided with a support portion 22*a* that rotatably supports the base end side of the foot board 4. While the support portion 22*a* accommodates a bearing member 41, in connection with the integral formation by casting, a metal sleeve element 42 for accommodating the bearing is separately attached in order for the bearing member 41 to be attached with great accuracy. The sleeve element 42 can be attached at the same time when casting the frame, preferably by previously inserting into a cast mold when casting the pedal frame. It goes without saying that the heel portion 22 may separately be formed and mounted.

As shown in FIG. 3, the rotation shaft 3 is pivotally supported by a bearing member 30 such as bearings assembled into the top end portions 21*a* of the right and left strut portions 21, and a substantially disk-shaped wheel 31 is fixed at the center position between the strut portions 21. To the wheel 31, one end of a chain being the coupling member 40 is fixed as being wrapped around, and the other end of the chain is fixed to the tip end portion of the foot board 4. The beater 5 is mounted at a position in the rotation shaft 3 adjacent to the wheel 31 so as to be closer to the center position. In the present embodiment, the description proceeds taking up an exemplary case in which a chain is used as the coupling member 40. However, as in the conventional ones, a leather or synthetic resin band, a timing belt or the like may be used. Further, as shown in FIG. 2, a cam 32 is fixed to a site of the rotation shaft 3 that projects outwardly from the strut portion 21. To the cam 32, the top end of a coil spring 33 arranged along the external side face of the strut portion 21 is coupled, and the bottom end of the coil spring 33 is coupled to a mounting portion 23 arranged in a projecting manner at the external side face of the root side of the strut portion 21 through an adjustment screw 24.

When the foot board 4 is depressed by the foot, the coupling member 40 is pulled down; the wheel 31 integrally rotates with the rotation shaft 3; and the beater 5 beats the drumhead. Here, the coil spring 33 is expanded by the rotation of the cam 32. When the depressing force is released from the foot board 4, the rotation shaft 3 reversely rotates by the resiliency of the coil spring 33, whereby the beater 5 and the foot board 4 recover the initial position, becoming ready for the next beat operation. While the foot board 4 is a plate-like casting product made with a metal material by casting similarly to the pedal frame 2, it may be implemented by a steel board, a synthetic resin board or the like.

Figure 7:
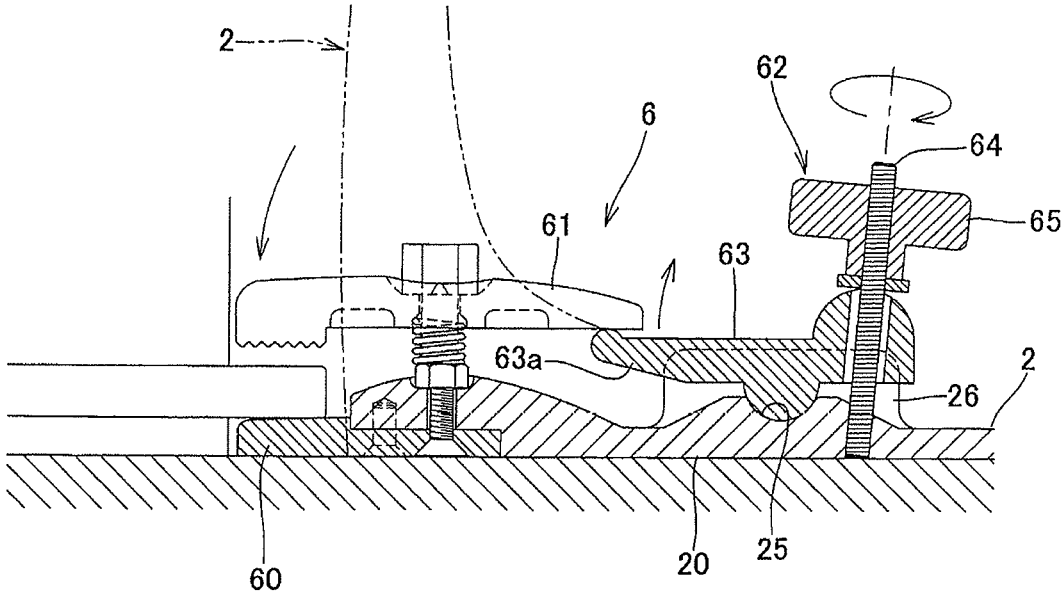
FIG. 7 is an explanatory cross-sectional view showing a substantial part of clamp means.

At the front end portion of the base portion 20 of the pedal frame 2, the clamp means 6 for clamping the lowermost point of the hoop of the bass drum is provided. Specifically, as shown in FIGS. 4 and 7, a hoop receiving piece 60 projecting frontward is mounted to the front end bottom face of the base portion 20, and a clamp element 61 for clamping the hoop between itself and the hoop receiving piece 60 projecting frontward in a similar manner is mounted to the front end top face of the base portion 20. Further, clamp operation means 62 for operating the clamp element 61 is arranged similarly to the top face of the base portion 20. The hoop receiving piece 60 may be formed integrally with the base portion 20. In the present embodiment, the hoop receiving piece 60 is structure as a separate member and fixed together with the clamp element 61 to the base portion 20 by a mounting screw so as to be interchangeable between right and left positions. As means for changing the position, a plurality of selectable screw holes are provided in the present embodiment. Other means, such as provision of a slide mechanism, is also possible. With a single type pedal in which only one beater 5 is provided such as in the present embodiment, it is preferable that the beater 5 strikes about the center of the drumhead, and the hoop receiving piece 60 and the clamp element 61 are fixed substantially at the same sideways position as the beater 5's position. The clamp element 61 has its intermediate portion in the front to rear direction rotatably and pivotally supported by the top face of the base portion 20. Further, at a position diagonally rearward relative to the clamp element 61, the clamp operation means 62 for lifting the rear end portion of the clamp element 61 to thereby downwardly rotate the front end portion of the clamp element 61 is provided.

Figure 13:
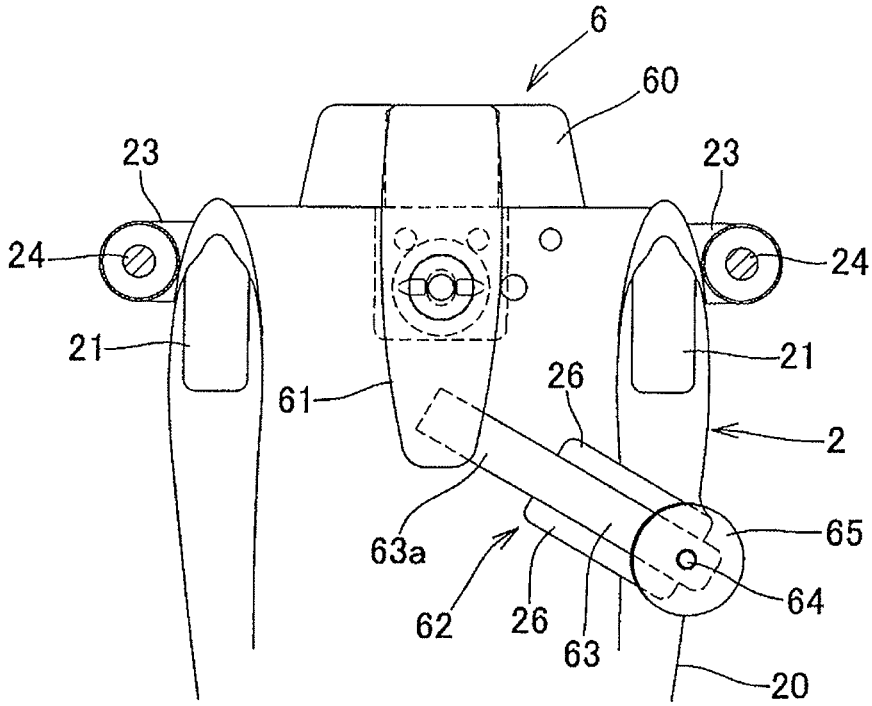
FIG. 13 is an explanatory view showing a substantial part of the pedal on the first pedal frame side.

As shown in FIG. 7, the clamp operation means 62 is structured with a cam member 63 that is upwardly and downwardly rotatably placed on a bearing portion 25 integrally formed with the top face of the base portion 20; a bolt shaft 64 that is arranged to stand up from the base portion 20 and passed through a top-bottom through groove provided at the rear end portion of the cam member 63; and an operational nut 65 that is screwed to the bolt shaft 64 and pushes downward the rear end portion of the cam member 63. The cam member 63 is disposed such that the tip end portion of an arm 63*a* extending frontward abuts on the bottom face of the rear end portion of the clamp element 61. When the operational nut 65 is tightened to push down the rear end portion of the cam member 63, the arm 63*a* is lifted up, whereby the rear end portion of the clamp element 61 is lifted up and the front end portion is rotated downward. Thus, the hoop of the bass drum can be clamped between the clamp element 61 and the hoop receiving piece 60. The cam member 63 is diagonally arranged as being clamped between a pair of clamp walls 26 integrally formed with the top face of the base portion 20, and placed on the bearing portion 25 between the clamp walls 26 so as to be capable of swinging. When the position of the clamp element 61 is changed between right and left positions, because the distance between the bearing portion 25 and the clamp element 61 changes as shown in FIGS. 4 and 13, the cam member 63 should likewise be changed to the optimum one that is different in length of the arm 63*a*, such that the clamp element 61 can be operated after such a positional change is made.

Figure 8:
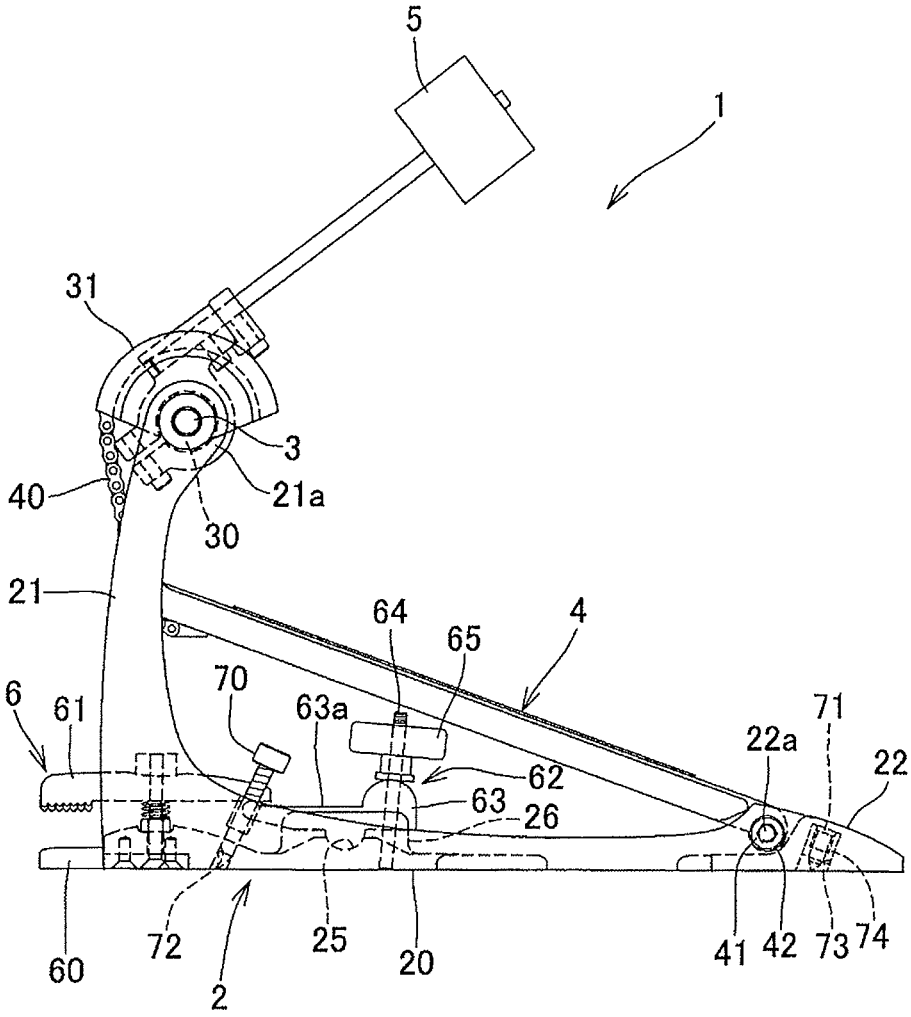
FIG. 8 is a side view showing a variation where spikes are provided.
Figure 9:
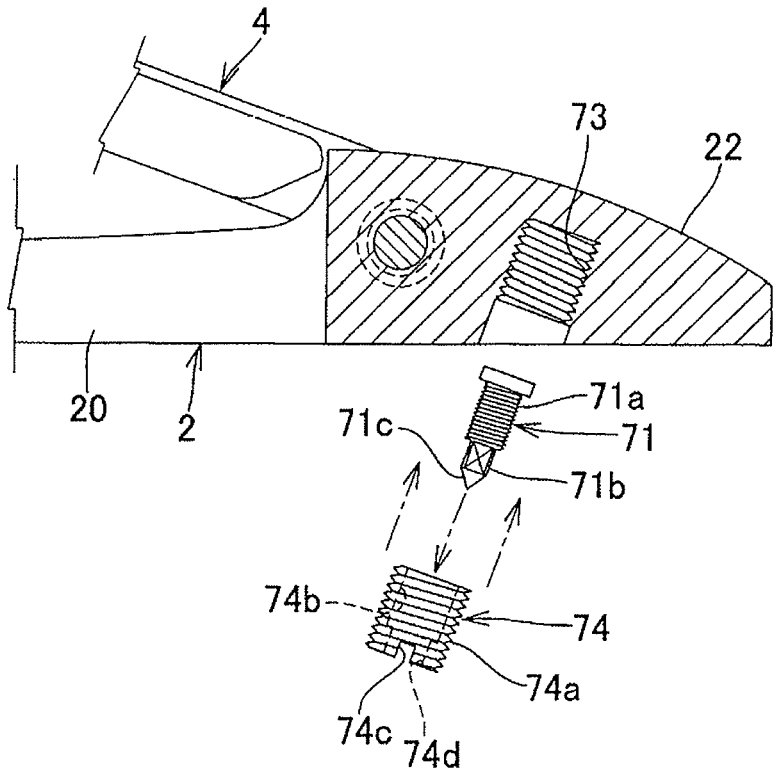
FIG. 9 is an explanatory cross-sectional view showing a mounting structure of a heel-side spike.
Figure 10:
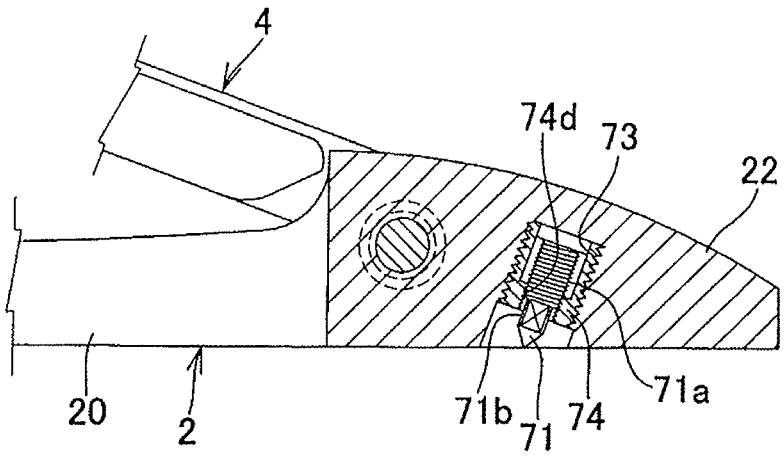
FIG. 10 is an explanatory cross-sectional view showing the heel-side spike.
Figure 10:
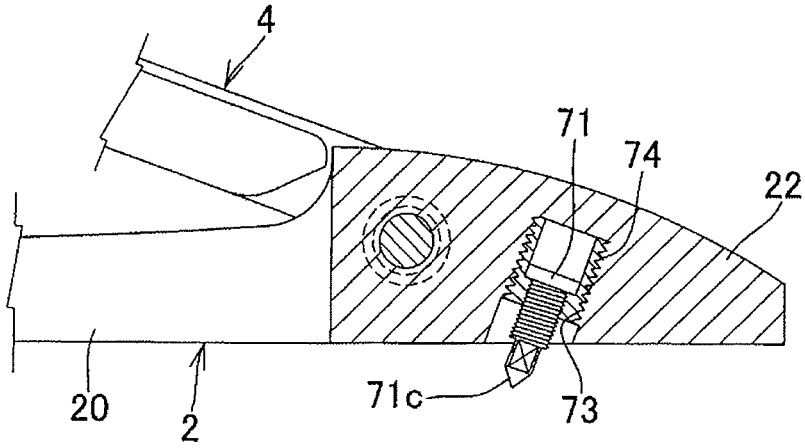
Figure 11:
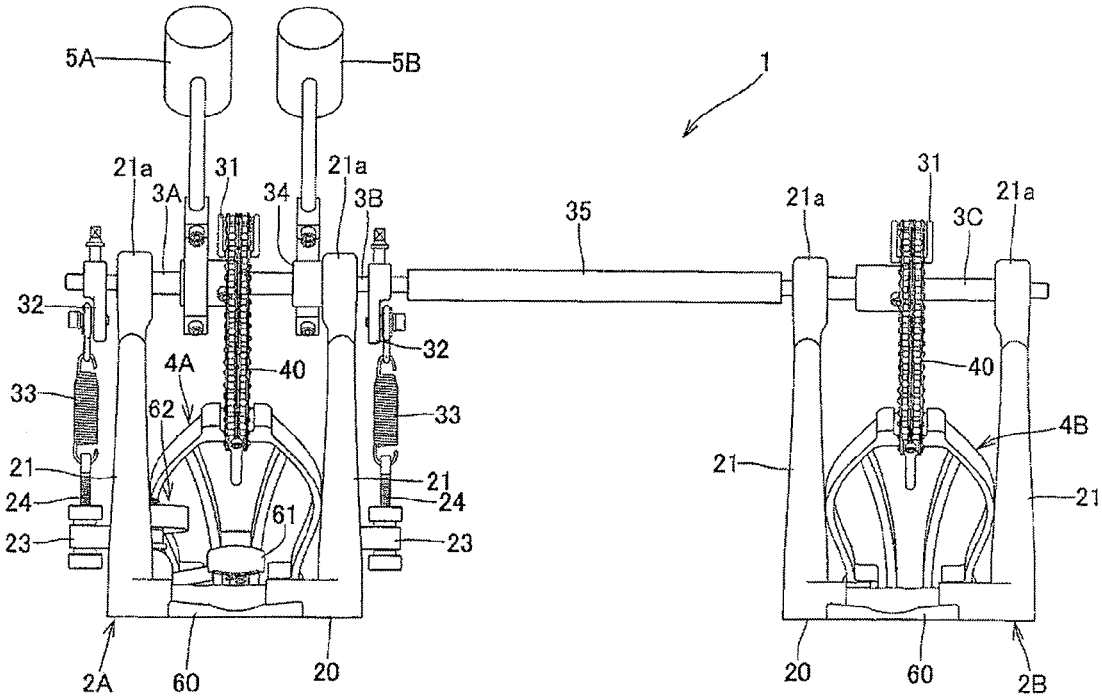
FIG. 11 is a side view showing a drum pedal according to a second embodiment of the present invention.

FIGS. 8 to 10 are explanatory views showing an exemplary case in which spikes 70 and 71 are provided to the pedal frame 2. In conventionally known drum pedals, such a spike is only provided on the toe side. With such a structure, the heel side may flip. In order to address such a problem, in the present exemplary case, in addition to the spikes 70 on the toe side, the spikes 71 are provided on the heel side also. The spikes 70 are provided to screw from above into a right and left pair of screw holes 72 formed at the base portion 20 to penetrate from the top to the bottom at further rear positions relative to the root portions of the strut portions 21. The spikes 70 are each structured such that rotation of the top side projecting head portion allows the bottom side point portion can be projected or retracted relative to the frame bottom face. As to the spikes 71, as shown in FIGS. 9 and 10, to a right and left pair of bottomed holes 73 opening at the bottom face of the heel portion 22, nut members 74 that allow the spikes 71 to be projected or retracted are mounted together with the spikes 71.

Formed on the base end side of each of the spikes 71 is a male screw portion 71*a* that screws with the nut member 74, and formed on the tip end side of each of the spikes 71 projecting from the nut member 74 is a square bolt portion 71*b* and a point portion 71*c*. Formed on the external side face of each of the nut members 74 is a male screw portion 74*a* that screws with the female screw thread of the bottomed hole 73. Inside each nut member 74, a stepwise storage groove 74*b* for storing the spike 71 is provided. On the bottom side of the storage groove 74*b*, a female screw portion 74*d* that screws with the male screw portion 71*a* of the spike 71 is provided. Formed at the bottom face of the nut member 74 is an engagement groove 74*c* for allowing any tool to engage therewith to rotate the nut member 74, such that the nut member 74 can be mounted in the bottomed hole 73 together with the spike 71. As shown in FIG. 10, it is structured such that, by rotating the square bolt portion 71*b* on the tip end side of the spike 71 by a dedicated tool, the point portion 71*c* is projected or retracted relative to the bottom face of the heel portion 22. It goes without saying that the present invention can be practiced in a mode in which only the toe-side spikes 70 are provided as in the conventional ones, or in which only the heel-side spikes 71 are provided.

Next, a second embodiment of the present invention will be described with reference to FIGS. 11 to 14.

The present embodiment is a drum pedal 1 structured as a double type, which includes for realizing rapid rolling to enhance the performance effect: first and second beaters 5A and 5B; first and second rotation shafts 3A and 3B to which the beaters are fixed; first and second foot boards 4A and 4B that allow the rotation respective shafts to rotate independently of each other, to thereby respectively allow the beaters 5A and 5B to actuate independently of each other; and first and second pedal frames 2A and 2B provided with the respective foot boards.

The first and second beaters 5A and 5B are both arranged on the first pedal frame 2A side that is fixed to the bass drum. The first and second rotation shafts 3A and 3B to which the respective beaters are fixed are also horizontally pivotally supported on the first pedal frame 2A, so as to be rotatable independently of each other. Here, because the strut portions 21 that support the rotation shafts are only two in number, it is necessary for a conventional double type pedal to pivotally support one end of the first rotation shaft by one strut portion while pivotally supporting one end of the second rotation shaft by the other strut portion, and to pivotally support the other end of the first rotation shaft by an auxiliary strut portion that is branched from the other strut portion in a substantially L shape. However, such an auxiliary strut portion branched in an L shape becomes a hindrance with the single type pedal described above. Accordingly, it has been difficult to manufacture the drum pedal using a common frame for both the single type and the twin type.

Figure 12:
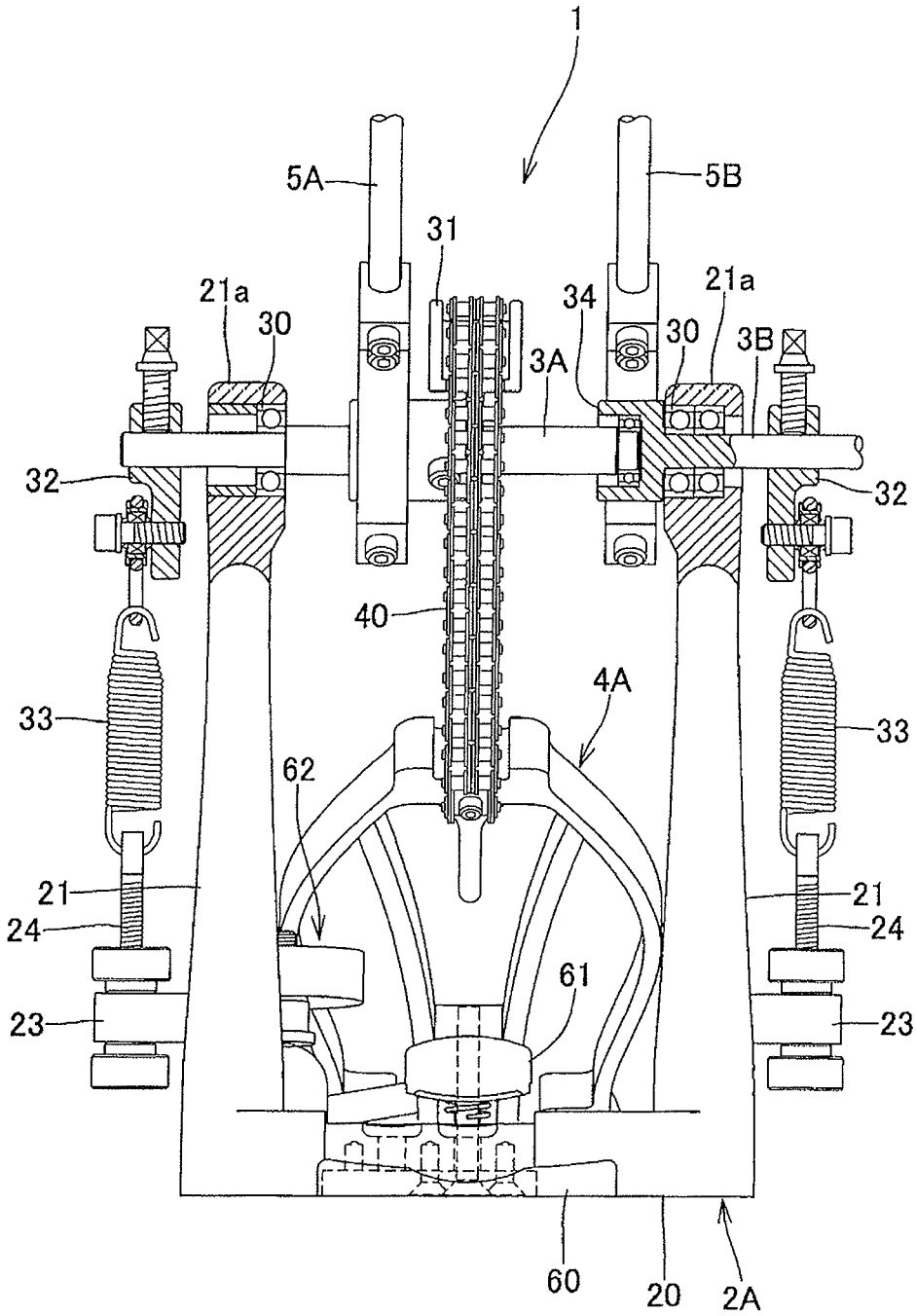
FIG. 12 is an explanatory view showing a structure of a pedal on a first pedal frame side.

Addressing this problem, as shown in FIG. 12, the present embodiment is structured to provide a bearing portion 34 at the end portion of the second rotation shaft 3B projecting between the strut portions 21, such that the bearing portion 34 pivotally supports the other end of the first rotation shaft 3A. This eliminates the necessity of the auxiliary strut portion such as seen in the conventional ones, making it possible to use a common frame for both the single type and the twin type. That is, both the pedal frames 2A and 2B can employ the same frame as the pedal frame 2 of the first embodiment, and in each of the pedal frames 2A and 2B, the base portion 20 and a right and left pair of strut portions 21 are integrally formed with a metal material by casting. With the pedal frame 2 of the first embodiment, because only one rotation shaft 3 is provided, the mounting portion 23 that supports the coil spring 33 for biasing the rotation shaft 3 to rotate is only provided to solely one strut portion 21. In contrast, the pedal frame 2A of the present embodiment is provided with the mounting portions 23 on both right and left sides for biasing the rotation shafts 3A and 3B to rotate independently of each other, while the pedal frame 2B is provided with none of such a mounting portion 23. However, it goes without saying that it is also possible to form the mounting portions 23 on both right and left sides previously when casting the frame, and to grind away the mounting portions 23 in accordance with the intended use of the product. Alternatively, it goes without saying that it is also possible not to originally form the mounting portions 23 integrally, but to provide the mounting portions 23 in the later process with use of screws or the like.

Figure 14:
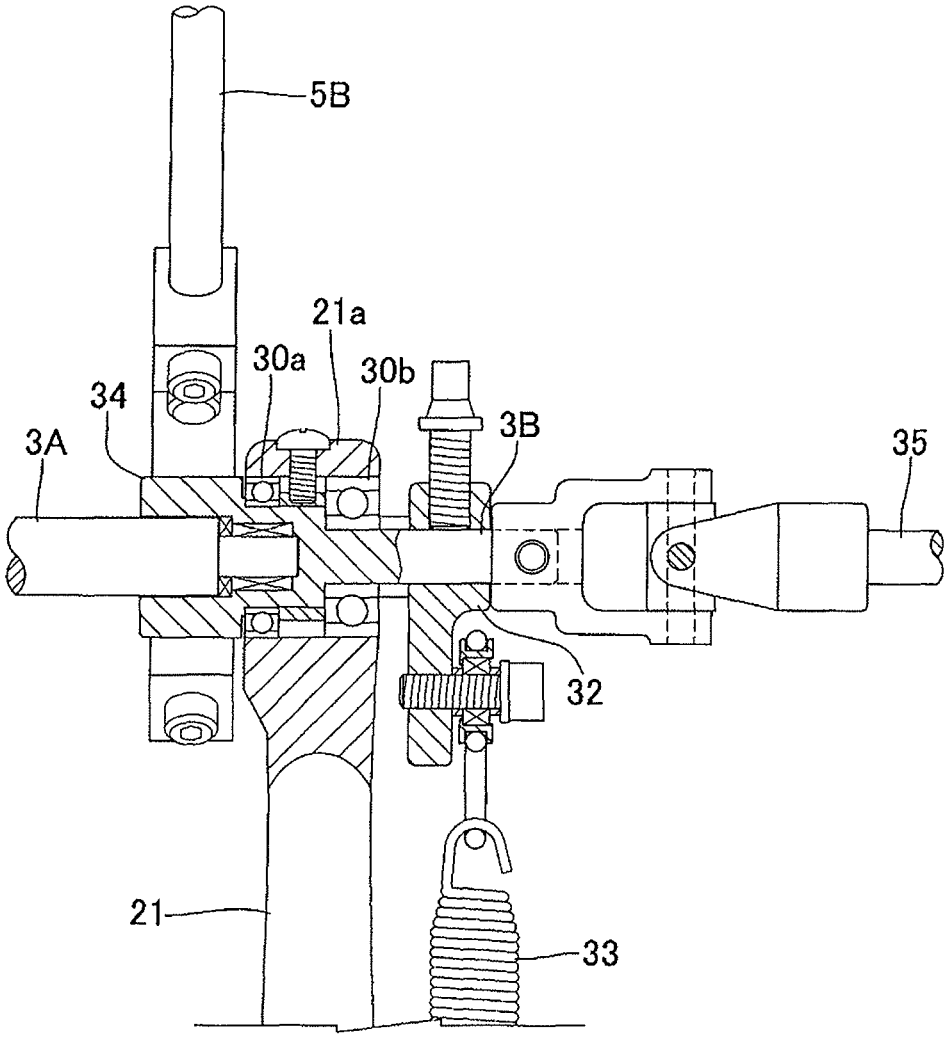
FIG. 14 is an explanatory view showing a variation of a support structure on the first pedal frame side.

FIG. 14 shows a variation of the support structure of the other end of the first rotation shaft 3A. As shown in FIG. 14, in the present variation, the bearing portion 34 at the end portion of the second rotation shaft 3B is rotatably supported by a bearing member 30*a* in a state where the entire bearing portion 34 or a partial base end side portion of the bearing portion 34 is inserted inside the strut portion 21, and the other end of the first rotation shaft 3A is likewise pivotally supported by the bearing portion 34 as being inserted into the bearing portion 34 to reach a position inside the strut portion 21. The second rotation shaft 3B is rotatably supported inside the strut portion 21 by a bearing member 30*b*.

In the embodiment shown in FIG. 12, a moment force is exerted from the bearing portion 34 supporting the first rotation shaft 3 to the second rotation shaft 3B, which causes a deviation (eccentricity, backlash) of the second rotation shaft 3B. Accordingly, when the depressing force of the player is strong, this deviation becomes great. This may hinder the smooth operation of the second rotation shaft 3B, and may prevent smooth actuation of the beater 5B. When the deviation of the second rotation shaft 3B is great, the bearing portion 34 also suffer from a deviation, whereby the actuation of the beater 5A also is adversely affected. On the other hand, according to the variation shown in FIG. 14, because the bearing portion 34 itself bearing the load of the first rotation shaft 3A is supported by the strut portion 21, the second rotation shaft 3B will not suffer from the moment force. Accordingly, any deviation of the rotation of the second rotation shaft 3B that hinders the operation will not occur. Hence, the second rotation shaft 3B can smoothly actuate the beater 5B without any effect from the operation of the first rotation shaft 3A, and the beater 5A can also smoothly actuate.

The application of the support structure according to the variation shown in FIG. 14 is not limited to the one in which the base portion 20 and the right and left pair of strut portions 21 are integrally formed with a metal material by casting as the pedal frames 2A and 2B of the present embodiment, and it can be applied similarly to the conventionally known double type drum pedal in which the strut frame made of aluminum by the die casting technique is mounted at a position near to the front side in the steel base plate. In such a case also, the operational effect similar to that described above can be achieved.

The wheel 31 is fixed to the first rotation shaft 3A at the center position between the strut portions 21. One end of the chain of the coupling member 40 is fixed to the wheel 31 as being wrapped around. The other end of the chain is fixed to the tip end portion of the foot board 4A. The beater 5A is mounted between the wheel 31 of the rotation shaft 3A and the strut portion 21 that pivotally supports the rotation shaft 3A. Further, a cam 32 is fixed to a site of the rotation shaft 3A that projects outwardly from the strut portions 21. To the cam 32, the top end of a coil spring 33 arranged along the external side face of the strut portion 21 is coupled, and the bottom end of the coil spring 33 is coupled to a mounting portion 23 arranged in a projecting manner at the external side face of the root side of the strut portion 21 through an adjustment screw 24.

To the second rotation shaft 3B, the beater 5B is mounted at the position projecting inwardly relative to the pivotally supported strut portion 21, i.e., in the present variation, at the outer circumference portion of the bearing portion 34, and a cam 32 is fixed to a site projecting outwardly from the strut portion 21. To the cam 32, the top end of a coil spring 33 arranged along the external side face of the strut portion 21 is coupled, and the bottom end of the coil spring 33 is coupled to a mounting portion 23 arranged in a projecting manner at the external side face of the root side of the strut portion 21 through an adjustment screw 24. With the twin type pedal provided with two beaters 5A and 5B as in the present embodiment, it is preferable that the beaters strike the bilaterally symmetric positions about the center of the drumhead, and the hoop receiving piece 60 and the clamp element 61 are fixed at the substantially center position relative to the beaters 5A and 5B positioned right and left.

In the second pedal frame 2B, the rotation shaft 3C is pivotally supported between the top end portions 21*a* of the strut portions 21. The wheel 31 is fixed to the rotation shaft 3C at the center position between the strut portions 21. One end of the chain of the coupling member 40 is fixed to the wheel 31 as being wrapped around. The other end of the chain is fixed to the tip end portion of the foot board 4B. The rotation shaft 3C is coupled to the second rotation shaft 3B through a coupling shaft 35 having a universal joint. When the second foot board 4B is depressed to rotate the rotation shaft 3C, this rotation is transferred to the second rotation shaft 3B through the coupling shaft 35, whereby the second beater 5B beats the drumhead of the bass drum.

In the foregoing, the description has been given of the embodiments of the present invention. However, the present invention is not limited to the embodiments, and it goes without saying that the present invention can be practiced in various modes within a range not departing from the gist of the present invention.

REFERENCE SIGNS LIST

1 drum pedal
2, 2A, 2B pedal frame
3, 3A, 3B, 3C rotation shaft
4, 4A, 4B foot board
5, 5A, 5B beater
6 clamp means
20 base portion
21 strut portion
21*a* top end portion
22 heel portion
22*a* support portion
23 mounting portion
24 adjustment screw
25 bearing portion
26 clamp wall
30 bearing member
31 wheel
32 cam
34 bearing portion
35 coupling shaft
40 coupling member
41 bearing member
42 sleeve element
60 hoop receiving piece
61 clamp element

62 clamp operation means
63 cam member
63*a* arm
64 bolt shaft
65 operational nut
70 spike
71 spike
71*a* male screw portion
71*b* square bolt portion
71*c* point portion
72 screw hole
73 bottomed hole
74 nut member
74*a* male screw thread
74*b* storage groove
74*c* engagement groove
74*d* female screw portion

The invention claimed is:

1. A drum pedal, comprising:

a pedal frame that has a frontward to rearward elongated base portion to be placed on a floor, a right and left pair of strut portions extending upward from a front end portion of the base portion, and a heel portion arranged at a rear end portion of the base portion;

a rotation shaft that has a beater for beating a drumhead mounted, and that is horizontally pivotally supported by top end portions of the strut portions; and a foot board that has its base end side rotatably supported by the heel portion, and that rotates the rotation shaft through a coupling member extending from its tip end side in accordance with a depressing operation of a player, wherein the base portion is long so as to reach the heel portion, and the base portion and the strut portions structuring the pedal frame are integrally formed with a metal material by casting.

2. A drum pedal, comprising:

a pedal frame that has a frontward to rearward elongated base portion to be placed on a floor, a right and left pair of strut portions extending upward from a front end portion of the base portion, and a heel portion arranged at a rear end portion of the base portion;

a rotation shaft that has a beater for beating a drumhead mounted, and that is horizontally pivotally supported by top end portions of the strut portions; and a foot board that has its base end side rotatably supported by the heel portion, and that rotates the rotation shaft through a coupling member extending from its tip end side in accordance with a depressing operation of a player, wherein the base portion and the strut portions structuring the pedal frame are integrally formed with a metal material by casting, wherein the strut portions respectively extend from right and left edge portions of the front end portion of the base portion, the strut portions being structured such that each of the strut portions is substantially continuously flush with the base portion.

3. The drum pedal according to claim 2, wherein the strut portions are tilted so as to be positioned further rearward as the strut portions are increased in height, and to be wider in frontward to rearward width as the strut portions are decreased in height, whereby each of rear end faces of the root portions of the strut portions is continuous to a top face of the base portion, drawing a gentle curve in a substantial C-shape as seen sideways.

4. The drum pedal according to claim 3, wherein the heel portion is also integrally formed when the casting with the metal material is carried out, and a metal sleeve element for accommodating a bearing member is separately attached to a support portion that supports the base end side of the foot board formed at the heel portion.

5. The drum pedal according to claim 4, wherein the attachment of the sleeve element is carried out by previously inserting the sleeve element into a cast mold when the casting with the metal material is carried out.

6. The drum pedal according to claim 5, wherein clamp means for clamping a hoop of a bass drum is provided at the front end portion of the base portion of the pedal frame, and the clamp means is positioned at a position interchangeable between right and left sides.

7. A double type drum pedal, comprising:

first and second beaters;

first and second rotation shafts that have the respective beaters fixed thereto;

first and second foot boards that allow the respective rotation shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, the base portion and the strut portions being integrally formed with a metal material by casting, one end of the first rotation shaft is pivotally supported by one of the pair of strut portions of the first pedal frame, a bearing portion is provided at an end portion of the second rotation shaft pivotally supported by other one of the pair of strut portions, the end portion projecting toward the first rotation shaft, and other end of the first rotation shaft is pivotally supported by the bearing portion.

8. A double type drum pedal, comprising:

first and second beaters;

first and second rotation shafts that have the respective beaters fixed thereto;

first and second foot boards that allow the respective rotation shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, the base portion and the strut portions being integrally formed with a metal material by casting, one end of the first rotation shaft is pivotally supported by one of the pair of strut portions of the first pedal frame, a bearing portion is provided at an end portion of the second rotation shaft pivotally supported by other one of the pair of strut portions, the bearing portion being rotatably supported by a bearing member in one of a state where the bearing portion is inserted into inside the other one of the pair of strut portions in its entirety and a state where a partial base end side portion of the bearing portion is inserted into inside the other one of the pair of strut portions, and other end of the first rotation shaft is pivotally supported by the bearing portion as being inserted into the bearing portion to reach a position inside the one of the pair of strut portions.

9. A double type drum pedal, comprising:

first and second beaters;

first and second rotation shafts that have the respective beaters fixed thereto;

first and second foot boards that allow the respective rotation shafts to rotate independently of each other, to thereby allow the respective beaters to actuate independently of each other; and first and second pedal frames that are provided with the respective foot boards, the first and second beaters, the first and second rotation shafts, and the first foot board being arranged on a first pedal frame side, and a rotation shaft being interlocked with the second rotation shaft through a coupling shaft and the second foot board rotating the rotation shaft being arranged on a second pedal frame side, wherein the first and second pedal frames are each provided with a frontward to rearward elongated base portion to be placed on a floor, a right and left pair of strut portions extending upward from a front end portion of the base portion, and a heel portion arranged at a rear end portion of the base portion, one end of the first rotation shaft is pivotally supported by one of the pair of strut portions of the first pedal frame, a bearing portion is provided at an end portion of the second rotation shaft pivotally supported by other one of the pair of strut portions, the bearing portion being rotatably supported by a bearing member in one of a state where the bearing portion is inserted into inside the other one of the pair of strut portions in its entirety and a state where a partial base end side portion of the bearing portion is inserted into inside the other one of the pair of strut portions, and other end of the first rotation shaft is pivotally supported by the bearing portion as being inserted into the bearing portion to reach a position inside the one of the pair of strut portions.

10. The drum pedal according to claim 1, wherein the strut portions are tilted so as to be positioned further rearward as the strut portions are increased in height, and to be wider in frontward to rearward width as the strut portions are decreased in height, whereby each of rear end faces of the root portions of the strut portions is continuous to a top face of the base portion, drawing a gentle curve in a substantial C-shape as seen sideways.

11. The drum pedal according to claim 10, wherein the heel portion is also integrally formed when the casting with the metal material is carried out, and a metal sleeve element for accommodating a bearing member is separately attached to a support portion that supports the base end side of the foot board formed at the heel portion.

12. The drum pedal according to claim 11, wherein the attachment of the sleeve element is carried out by previously inserting the sleeve element into a cast mold when the casting with the metal material is carried out.

13. The drum pedal according to claim 12, wherein clamp means for clamping a hoop of a bass drum is provided at the front end portion of the base portion of the pedal frame, and the clamp means is positioned at a position interchangeable between right and left sides.

14. The drum pedal according to claim 1, wherein the heel portion is also integrally formed when the casting with the metal material is carried out, and a metal sleeve element for accommodating a bearing member is separately attached to a support portion that supports the base end side of the foot board formed at the heel portion.

15. The drum pedal according to claim 2, wherein the heel portion is also integrally formed when the casting with the metal material is carried out, and a metal sleeve element for accommodating a bearing member is separately attached to a support portion that supports the base end side of the foot board formed at the heel portion.

16. The drum pedal according to claim 15, wherein the attachment of the sleeve element is carried out by previously inserting the sleeve element into a cast mold when the casting with the metal material is carried out.

17. The drum pedal according to claim 1, wherein clamp means for clamping a hoop of a bass drum is provided at the front end portion of the base portion of the pedal frame, and the clamp means is positioned at a position interchangeable between right and left sides.

18. The drum pedal according to claim 2, wherein clamp means for clamping a hoop of a bass drum is provided at the front end portion of the base portion of the pedal frame, and the clamp means is positioned at a position interchangeable between right and left sides.

19. The drum pedal according to claim 3, wherein clamp means for clamping a hoop of a bass drum is provided at the front end portion of the base portion of the pedal frame, and the clamp means is positioned at a position interchangeable between right and left sides.

* * * * *